United States Patent [19]

Yoshizawa et al.

[11] Patent Number: 4,925,780

[45] Date of Patent: May 15, 1990

[54] DIRECT POSITIVE SILVER HALIDE LIGHT-SENSITIVE COLOR PHOTOGRAPHIC MATERIAL

[75] Inventors: Tomimi Yoshizawa; Keiji Ogi; Atushi Kamitakahara, all of Hino, Japan

[73] Assignee: Konica Corporation, Tokyo, Japan

[21] Appl. No.: 234,023

[22] Filed: Aug. 18, 1988

[30] Foreign Application Priority Data

Aug. 20, 1987 [JP] Japan ..... 62-207906

[51] Int. Cl.[5] ..... G03C 1/485; G03C 1/12

[52] U.S. Cl. ..... 434/589; 430/404; 430/522; 430/547; 430/583; 430/587; 430/596; 430/585; 430/550; 430/498; 430/409

[58] Field of Search ..... 430/589, 583, 587, 550, 430/596, 585, 547, 522, 598, 409

[56] References Cited

U.S. PATENT DOCUMENTS

| | | | |
|---|---|---|---|
| 4,102,688 | 6/1978 | Sugiyama et al. | 430/587 |
| 4,147,547 | 4/1979 | Koitabashi et al. | 430/589 |
| 4,444,874 | 4/1984 | Silverman et al. | 430/409 |

*Primary Examiner*—Paul R. Michl
*Assistant Examiner*—Thorl Chea
*Attorney, Agent, or Firm*—Jordan B. Bierman

[57] ABSTRACT

A direct positive silver halide light-sensitive color photographic material comprising, on a support, (1) at least three light-sensitive silver halide emulsion layers containing internal latent image-type light-sensitive silver halide grains, (2) specific sensitizing dyes having formulas [I], [II] and [III], respectively defined in the specification, and (3) at least one anti-irradiation compound selected from the group consisting of those compounds having formulas [IV], [V] and [VI], respectively defined in the specification, is disclosed.

7 Claims, No Drawings

DIRECT POSITIVE SILVER HALIDE LIGHT-SENSITIVE COLOR PHOTOGRAPHIC MATERIAL

FIELD OF THE INVENTION

The present invention relates to a direct positive silver halide light-sensitive color photographic material, and more particularly to an internal latent image-type direct positive silver halide light-sensitive color photographic material which is capable of stably forming positive images.

BACKGROUND OF THE INVENTION

Obtaining direct positive images on color photographic paper or color film from such originals as printed graphic images or color reversal-type positive images by a procedure of photographing them on an internal latent image-type silver halide light-sensitive photographic paper or film (hereinafter referred to as a light-sensitive material) inside a photocopying apparatus and fogging the light-sensitive material while in a color developing solution and then developing it has recently been made a practical reality, and copying originals on the spot by such the copying operation at copying shops, photo stores or general offices where copying machines are installed is now prevailing.

As the method for fogging the light-sensitive material in a color developing solution there are known two different methods: one is for chemically fogging the light-sensitive material by using a fogging agent (chemically fogging method) and the other for uniformly overall exposing the light-sensitive plane to light (light-fogging method). The chemically fogging method, however, has the disadvantage that the fogging agent, since it functions only at a high pH (e.g., 11 or more), is prone to be decomposed.

On the other hand, the light-fogging method, since it has such a flexibility that it uses a light source whose intensity is electrically controllable and whose color temperature is discretionarily changeable by a filter or the like, has come into practical use.

In an internal latent image-type light-sensitive material, various dyes are used for the purpose of preventing irradiation from occurring at the time of imagewise exposure. Such the dye, when the light-sensitive material is immersed in a developer solution, is not immediately dissolved out nor decolored, thus affecting the subsequent light-fogging process. Such antiirradiation dyes (AI dyes), which are generally slow in decolorization, retard the start of light-fogging effect. The light-fogging effect is affected also by a sensitizing dye that is adsorbed to an internal latent image-type silver halide emulsion: many of sensitizing dyes, in most cases, retard the emulsions's generation of the maximum density and expedite the rise in the minimum density, so that the light-fogging condition's allowable range is very narrow.

In addition to the above, the light-fogging characteristics in the case of actually light-fogging the light-sensitive material in a color developer solution may be fluctuated as a result of being variously affected by, e.g., the temperature, pH or halide ion concentration of the developer solution, and deterioration in the luminance of the light source used, and the like. Therefore, in order to obtain always stably sufficiently high maximum color density and sufficiently low minimum color density, the light-fogging condition's allowable range (hereinafter referred to as the light-fogging latitude) needs to be sufficiently wide.

However, merely making attempts to replace sensitizing dyes or change AI dyes cannot sufficiently widen the light-fogging latitudes of the blue-sensitive layer, green-sensitive layer and red-sensitive layer, and thus it is difficult to prevent the maximum density from decreasing as well as the minimum density from increasing.

SUMMARY OF THE INVENTION

It is therefore an object of the present invention to provide an internal latent image-type direct positive color light-sensitive material which has a wide light-fogging latitude and excellently stable developability.

The above object of the present invention is accomplished by an internal latent image-type direct positive silver halide light-sensitive color photographic material which comprises at least three light-sensitive layers containing sensitizing dyes having the following Formulas [I], [II] and [III], respectively, and each containing at least one compound selected from the group consisting of those compounds having the following Formulas [IV], [V] and [VI]:

Formula [I]

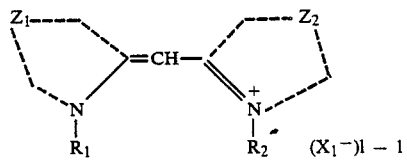

wherein $Z_1$ and $Z_2$ each is a group of atoms necessary to form a benzothiazole ring, naphthothiazole ring, benzoselenazole ring or naphthoselenazole ring; $R_1$ and $R_2$ each is a substituted or unsubstituted alkyl group, provided that at least one of the $R_1$ and $R_2$ is a sulfo or carboxyl group-substituted alkyl group; $X_1^-$ is an anion; and 1 is an integer of 1 or 2.

Formula [II]

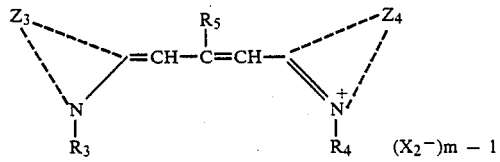

wherein $Z_3$ and $Z_4$ each is a group of atoms necessary to form a benzoxazole ring or naphthoxazole ring; $R_3$ and $R_4$ each is a substituted or unsubstituted alkyl group, and $R_5$ is an lower alkyl group, provided that at least one of the $R_3$ and $R_4$ is a sulfo or carboxyl group-substituted alkyl group; $X_2^-$ is an anion; and m is an integer of 1 or 2.

Formula [III ]

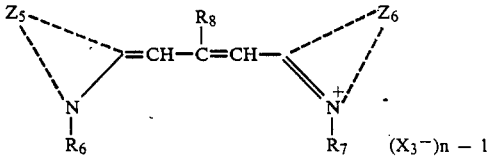

wherein $Z_5$ and $Z_6$ each is a group of atoms necessary to form a benzothiazole ring, naphthothiazole ring, benzoselenazole ring or naphthoselenazole ring; $R_6$ and $R_7$ each is a substituted or unsubstituted alkyl group, and $R_8$ is an alkyl or aryl group, provided that at least one of the $R_6$ and $R_7$ is a sulfo or carboxyl group-substituted alkyl group; $X_3^-$ is an anion; and n is an integer of 1 or 2.

Formula [IV]

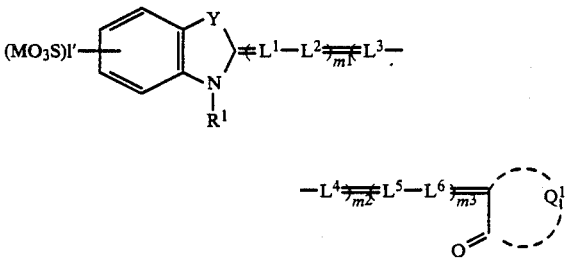

wherein Y is an oxygen atom, $=NR_2$, $=C(CH_3)$ or a sulfur atom; $Q^1$ is a group of atoms necessary to form a pyrazolone ring, isooxazolone ring, barbituric acid ring, thiobarbituric acid ring, tetrahydropyridine-2,6-dione ring or pyrazolo[3,4-b]pyridine-3,6-dione ring; $R^1$ and $R^2$ each is an alkyl group; M is a hydrogen atom or a cation; $L^1$, $L^2$, $L^3$, $L^4$, $L^5$ and $L^6$ each is a methine group; l' is an integer of 1 or 2; and $m^1$, $m^2$ and $m^3$ each is zero or 1.

Formula [V]

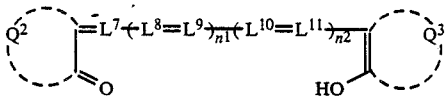

wherein $Q^2$ and $Q^3$ each is a group of atoms necessary to form an isooxazolone ring, barbituric acid ring, thiobarbituric acid ring, tetrahydropyridine-2,6-dione ring, pyrazolo[3,4-b]pyridine-3,6-dione ring or

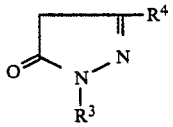

or a tautomer of each of these keto rings; $R_3$ is an aryl group; $R_4$ is a carbamoyl group, alkoxycarbonyl group, aryloxycarbonyl group, perfluoroalkyl group or cyano group; provided that at least one of the $Q^2$ and $Q^3$ has a sulfo or carboxyl group-substituted alkyl, aryl or heterocyclic group; $L^7$, $L^8$, $L^9$, $L^{10}$ and $L^{11}$ each is a methine group; and $n^1$ and $n^2$ each is an integer of zero or 1.

Formula [VI]

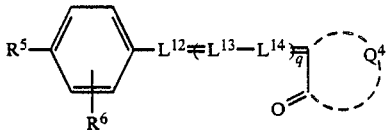

wherein $Q^4$ is a group of atoms necessary to form an isooxazolone ring, barbituric acid ring, thiobarbituric acid ring, pyrazolo[3,4-b]pyridine-3,6-dione ring or

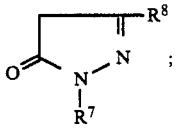

$R^7$ and $R^8$ represent the same groups as defined in the $R^3$ and $R^4$, respectively, of Formula [V]; $R^5$ is an alkoxy group or amino group; $R^6$ is a hydrogen atom, halogen atom, alkyl or alkoxy group; $L^{12}$, $L^{13}$, and $L^{14}$ each is a methine group; and q is an integer of zero or 1.

DETAILED DESCRIPTION OF THE INVENTION

Those sensitizing dyes having Formulas [I], [II] and [III] to be used in the silver halide light-sensitive photographic material of this invention will now be illustrated in detail.

Formula [I]

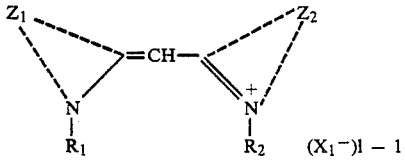

wherein the rings represented by the $Z_1$ and $Z_2$ may be either the same or different, and may each be a ring such as of benzothiazole, naphtho[1,2-d]thiazole, naphtho[2,1-d]thiazole, naphtho[2,3-d]thiazole, benzoselenazole, naphtho[1,2-d]selenazole, naphtho[2,1-d]selenazole, naphtho[2,3-d]Selenazole, and the like. Preferred among these is the benzothiazole ring.

The above ring is allowed to have two or more of various substituents.

Preferred examples of such substituents include hydroxy group, halogen atoms (e.g., fluorine, chlorine, bromine), nonsubstituted or substituted alkyl groups (such as methyl, ethyl, propyl, isopropyl, hydroxyethyl, carboxyethyl, carboxymethyl, ethoxycarbonylmethyl, trifluoromethyl, chloroethyl, methoxymethyl, etc.), aryl groups or substituted aryl groups (such as phenyl, tolyl, anisyl, chlorophenyl, 1-naphthyl, 2-naphthyl, carboxyphenyl, etc.), heterocyclic groups (such as 2-thienyl, 2-furyl, 2-pyridyl, etc.), aralkyl groups (such as benzyl, phenethyl, 2-furyl-methyl, etc.), alkoxy groups (such as methoxy, ethoxy, butoxy, etc.). alkylthio groups (such as methylthio, ethylthio, etc.), carboxy group, alkoxycarbonyl groups (such as methoxycarbonyl, ethoxycarbonyl, butoxycarbonyl, etc.). acylamino groups (such as acetylamino, propionylamino, etc.), and two or more adjacent groups-linked methylenedioxy groups, tetramethylene groups, and the like.

Examples of the substituted or unsubstituted alkyl group represented by the $R_1$ or $R_2$ include methyl, ethyl, propyl, butyl, isopropyl, pentyl, hexyl, 2-hydroxyethyl, 3-hydroxypropyl, 2-(2-hydroxyethoxy)ethyl, ethoxycarbonylmethyl, 2-phosphonoethyl, 2-chloroethyl, 2,2,2-trifluoroethyl, 2,2,3,3-tetrafluoropropyl, 2-carbamoylethyl, 3-carbamoylpropyl, methoxyethyl, ethoxyethyl, methoxypropyl, benzyl, phenethyl, p-sulfophenethyl, m-sulfophenethyl, p-carboxyphenethyl, and the like groups.

At least either one of the $R_1$ and $R_2$ is a sulfo or carboxyl group-substituted alkyl group: examples of the carboxyl group-substituted alkyl group include carboxymethyl, 2-carboxyethyl, 3-carboxypropyl and the like groups, and examples of the sulfo group-substituted alkyl group include 2-sulfoethyl, 3-sulfopropyl, 3-sulfobutyl, 4-sulfobutyl, 2-hydroxy-3-sulfopropyl, 2-(3-sulfopropyloxy)ethyl. 2-sulfatoethyl, 3-sulfatopropyl and the like groups. The number of carbon atoms of such the sulfo or carboxyl group-substituted alkyl group is preferably not more than 5.

The anion represented by the $X_1^-$ is the anion of chlorine or an inorganic or organic acid, provided, where the $R_1$ or $R_2$ is a sulfoalkyl group and forms an intramolecular salt with the nitrogen atom on the condensed heterocyclic ring, the $X_1^-$ may not be present (l =1).

Formula [II]

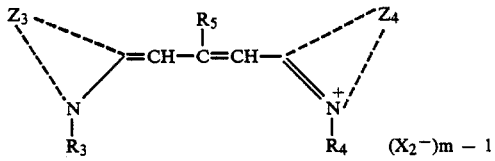

wherein the rings represented by the $Z_3$ and $Z_4$ may be either the same or different, and may each be a ring such as of benzoxazole, naphtho[2,1-d]oxazole, naphtho[1,2-d]oxazole, naphtho[2,3-d]oxazole, or the like.

On the above ring 1 or 2 or more substituents may be present, preferred examples of which include similar groups to those described in the foregoing Formula [I].

Examples of the substituted or unsubstituted alkyl group represented by the $R_3$ or $R_4$ include similar groups to those represented by the $R_1$ or $R_2$ in Formula [I].

At least either one of the $R_3$ and $R_4$ is a sulfo or carboxyl group-substituted alkyl group, which includes similar groups to those as defined in the $R_1$ and $R_2$ of Formula [I]:

The lower alkyl group represented by the $R_5$ is preferably an alkyl group having not more than 4 carbon atoms, such as methyl, ethyl or propyl group.

The anion represented by the $X_2^-$ is as defined in the $X_1^-$ of Formula [I].

Formula [III]

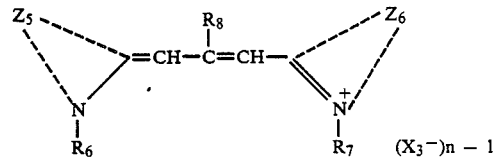

wherein the rings represented by the $Z_5$ and $Z_6$ may be either the same or different, and may each be a benzothiazole ring, naphtho[1,2-d]thiazole, naphtho[2,1-d]thazole ring, naphtho[2,3-d]thiazole ring, or the like.

The above ring may have or 2 or more substituents. Preferred examples of such substituents include similar groups to those as defined in Formula [I].

Preferred examples of the substituted or unsubstituted alkyl group represented by the $R_6$ or $R_7$ include similar groups to those represented by the $R_1$ or $R_2$ of Formula [I].

At least either one of the $R_6$ and $R_7$ is a sulfo or carboxyl group-substituted alkyl group, examples of which include similar groups to those as defined in the $R_1$ and $R_2$ of Formula [I].

The alkyl group represented by the $R_8$ includes those substituted alkyl groups such as methyl, ethyl, propyl, benzyl, and phenethyl. The aryl group represented by the $R_8$ is prefferably a phenyl group. The anion represented by the $X_3^-$ is as defined in the $X_1^-$ of Formula [I].

The following are typical examples of the sensitizing dyes having the foregoing Formulas [I], [II] and [III], which are applicable to this invention, but the invention is not limited to and by the examples.

I-1

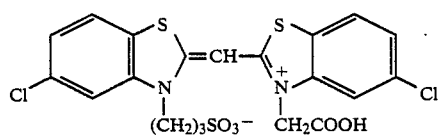

I-2

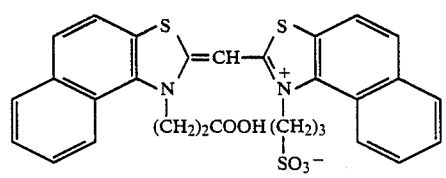

I-3

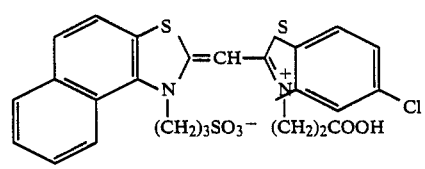

-continued
I-4
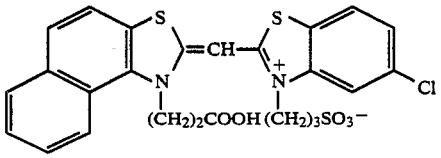
I-5
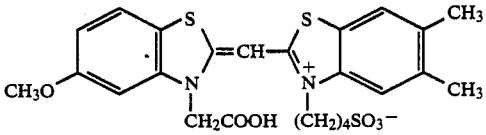
I-6
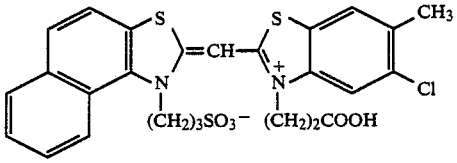
I-7
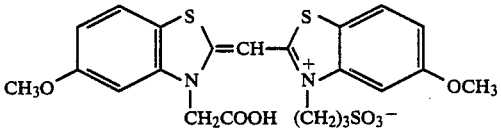
I-8
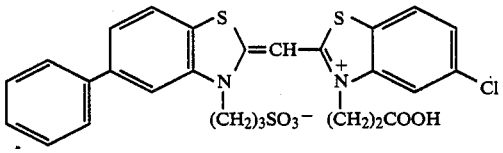
I-9
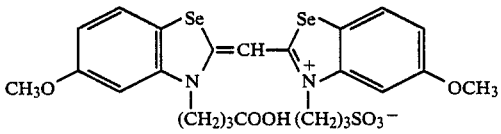
I-10
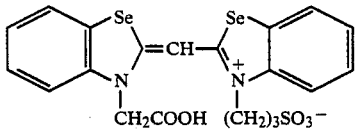
I-11
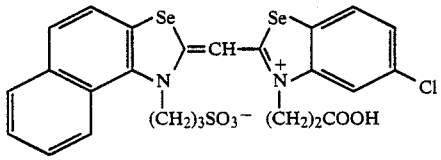
I-12
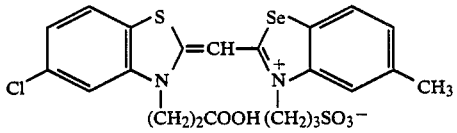

-continued
I-13
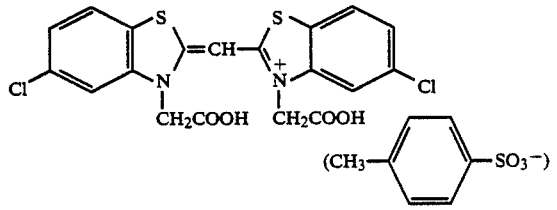
I-14
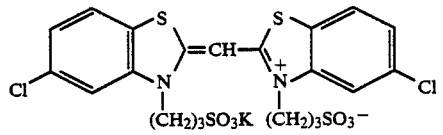
I-15
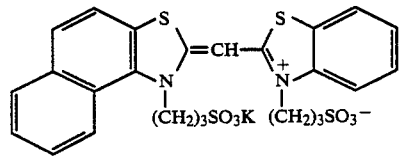
I-16
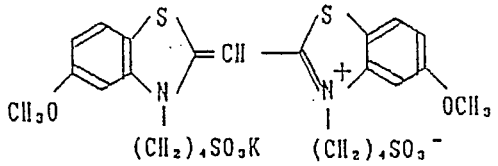
II-1
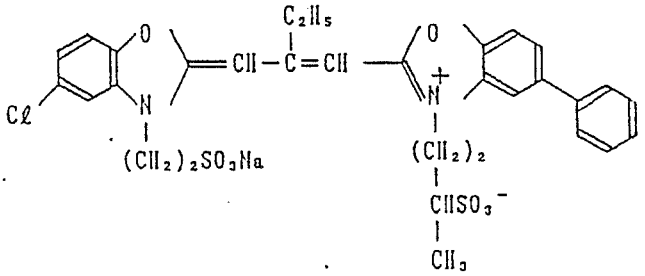
II-2
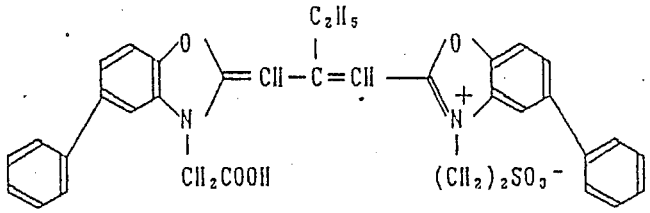
II-3
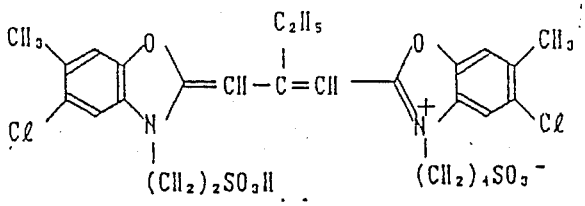

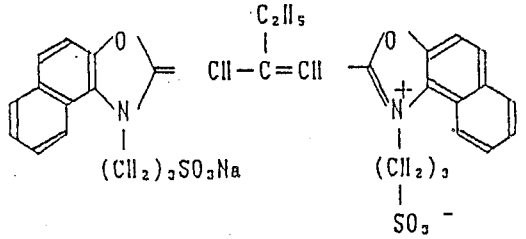
II −4
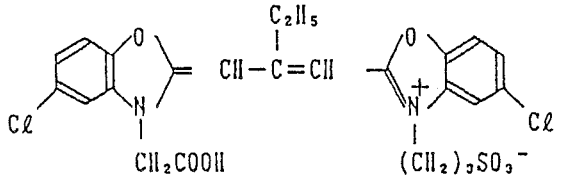
II −5
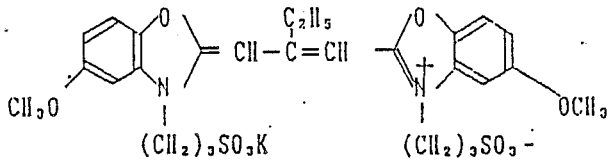
II −6
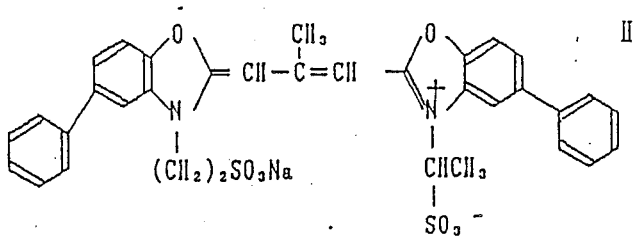
II −7
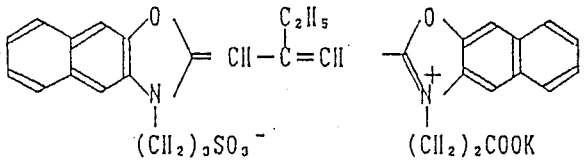
II − 8
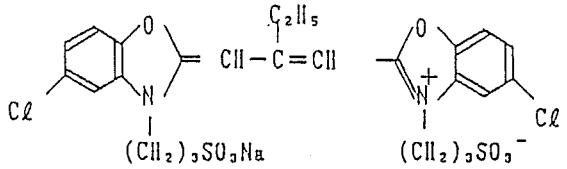
II − 9
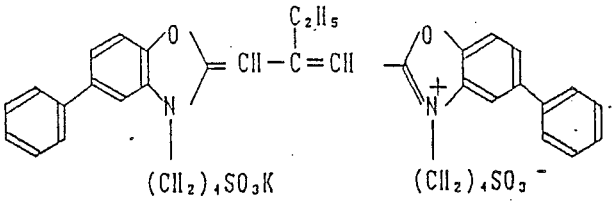
II −10
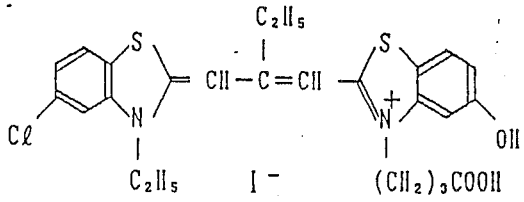
III −1

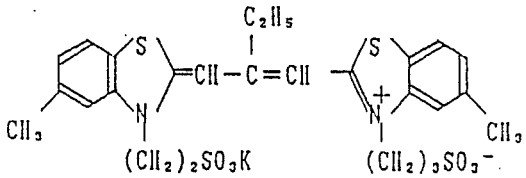
Ⅲ－2
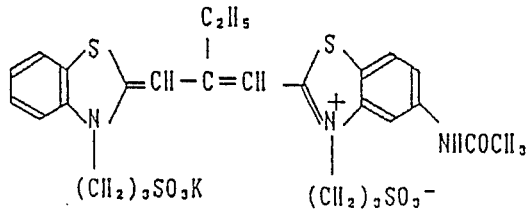
Ⅲ－3
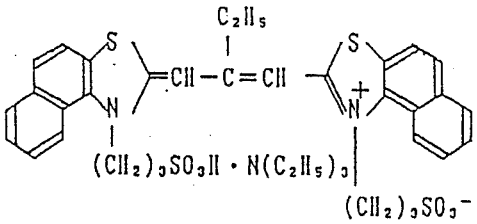
Ⅲ－4
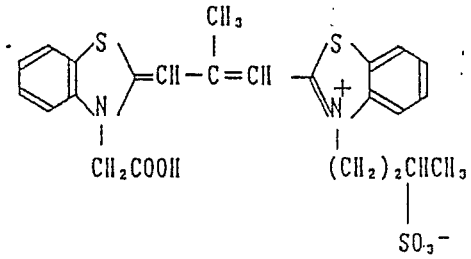
Ⅲ－5
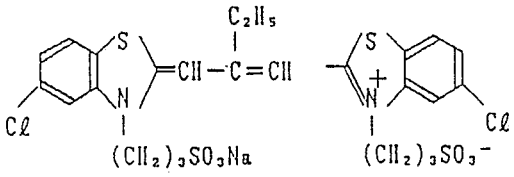
Ⅲ－6
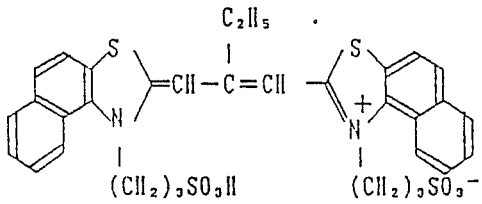
Ⅲ－7
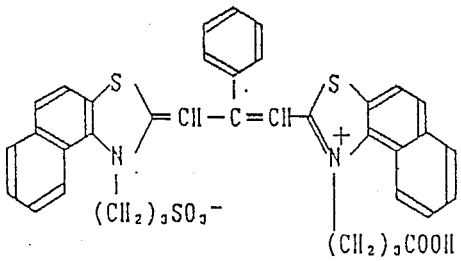
Ⅲ－8

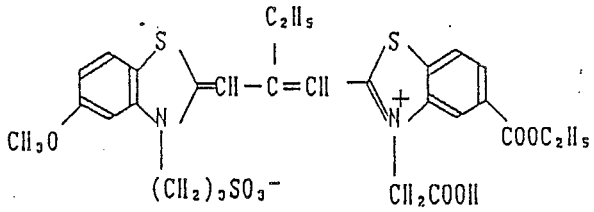
III −9
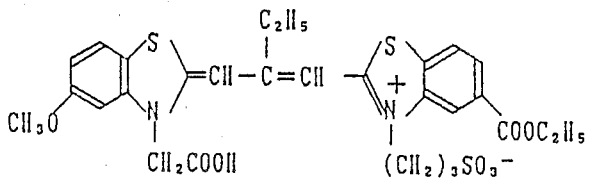
III −10
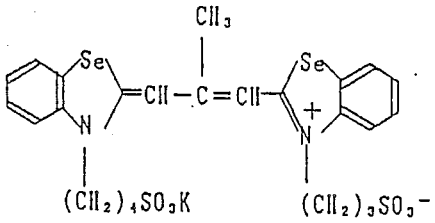
III −11
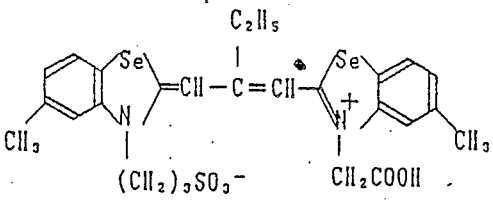
III −12
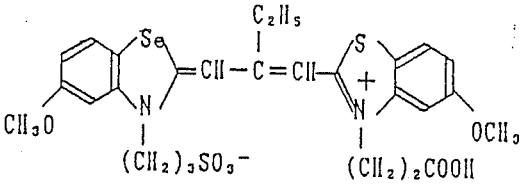
III −13
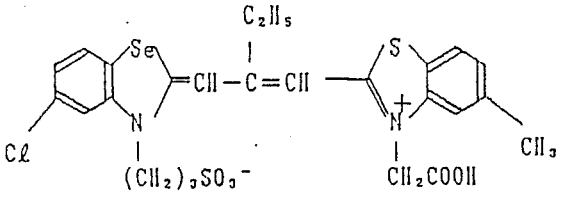
III −14
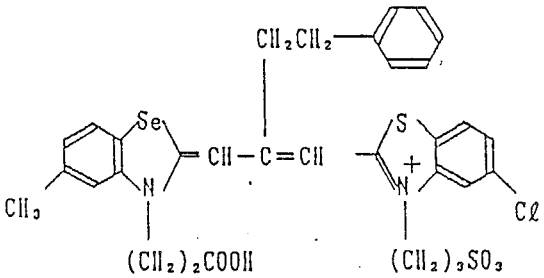
III −15

These sensitizing dyes represented by Formulas [I], [II] and [III] are of the prior art, and they may be synthesized by making reference to, e.g., F. M. Hamer: 'The Chemistry of Heterocyclic Compounds, Vol. 18, Cyanine Dyes and Related Compounds' Interscience Publishers, N.Y., (1964), or D. M. Sturmer: the same journal, Vol.30, p.411 (1977).

These sensitizing dyes represented by Formulas [I], [II] and [III] can be incorporated into any appropriate layer. However, according to the most preferable embodiment of the present invention, the sensitizing dye of Formula [I] is incorporated in a blue-sensitive emulsion layer, the sensitizing dye of Formula [II] in a green-sensitive emulsion layer, and the sensitizing dye of Formula [III] in a red-sensitive emulsion layer.

The adding amount of such the sensitizing dye of this invention to a silver halide emulsion, although it depends on the type of the emulsion to be used or the structure of the dye to be added, is generally from $3\times10^{-6}$ to $2.5\times10^{-2}$ mole per mole of Silver halide, preferably from $3\times10^{-5}$ to $9\times10^{-3}$ mole and more preferably from $3\times10^{-4}$ to $3\times10^{-3}$ mole.

Subsequently, those antiirradiation dyes having the foregoing Formulas [IV], [V] and [VI] will now be explained.

In Formula [IV], the ring formed by the $Q^1$ includes those represented by the following Formulas [Q-1] through [Q-6]:

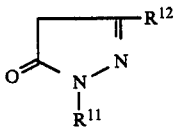

[Q-1]

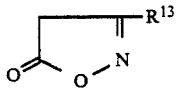

[Q-2]

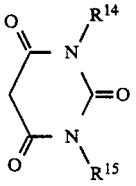

[Q-3]

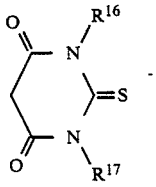

[Q-4]

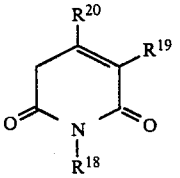

[Q-5]

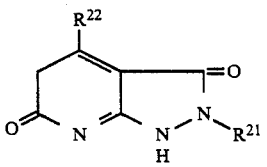

[Q-6]

wherein $R^{11}$, $R^{13}$, $R^{14}$, $R^{15}$, $R^{16}$, $R^{17}$, $R^{18}$, $R^{20}$, $R^{21}$ and $R^{22}$ each is a hydrogen atom or an alkyl or aryl group; $R^{12}$ is an alkyl, alkoxy, aryl, amino, carboxyl, carbamoyl, alkoxycarbonyl or aryloxycarbonyl group; and $R^{19}$ is a cyano, acyl, carbamoyl or alkoxycarbonyl group.

The alkyl group represented by the $R^1$ includes those substituted alkyl groups such as methyl, ethyl, propyl, methoxyethyl, hydroxyethyl, carboxymethyl, sulfopropyl, allyl, benzyl, p-sulfobenzyl, phenethyl, and the like.

The alkyl group represented by the $R_2$ may also be substituted, which includes those groups such as methyl, ethyl, butyl, allyl, hydroxypropyl, 2,2,3,3-tetrafluoropropyl, benzyl and the like.

The methine groups represented by the $L^1$ through $L^6$ may each have a substituent (such as methyl, ethyl, or chlorine), and a carbocyclic ring may be formed between the $L^2$ and $L^3$ or between the $L^4$ and $L^5$.

The cation represented by the M is ammonium, a metal (such as lithium, sodium, potassium, calcium or magnesium), an organic ammonium (such as pyridinium, triethyl ammonium or ethanol ammonium), or the like.

In Formula [V], the rings formed by the $Q^2$ and $Q^3$ include those of [Q-2] through [Q-6] as defined in the $Q^1$ of Formula [IV] and

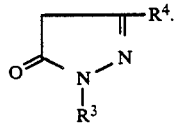

The aryl group represented by the $R^3$ is desirable to have a water-soluble group such as a sulfo group.

The sulfo or carboxyl group-substituted alkyl, aryl or heterocyclic group which is at least either one of the $Q^2$ and $Q^3$ is a group such as sulfopropyl, sulfobutyl, carboxymethyl, 4-sulfophenyl, 4-carboxyphenyl, 2,5-disulfophenyl, 3-sulfopyridyl, 6-sulfobenzothiazolyl or the like.

The methine groups represented by the $L^7$ through $L^{11}$ may each have a substituent (such as methyl, ethyl or chlorine).

In Formula [VI], the ring formed by the $Q^4$ includes those of the [Q-2], [Q-3], [Q-4] and [Q-6] as defined in Formula [IV] and

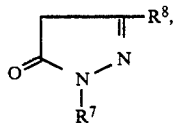

wherein $R^7$ and $R^8$ are the same as the $R^3$ and $R^4$, respectively, in Formula [V].

The alkoxy group represented by the $R^5$ includes those substituted alkoxy groups, such as methoxy, ethoxy, methoxyethoxy, 3-sulfopropoxy and the like. The amino group represented by the $R^5$ also includes those substituted amino groups, such as amino, methylamino, dimethylamino, N-ethyl-N-cyanoethylamino, sulfopropylamino, N,N-decamethyleneamino, bis(carboxymethyl)amino and the like. Further, the amino group may be linked through a carbon chain with a phenyl group to form

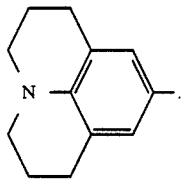

The alkyl or alkoxy group represented by the $R^6$ is preferably a lower alkyl group or a lower alkoxy group each having not more than 4 carbon atoms.

The methine chains represented by the $L^{12}$, $L^{13}$ and $L^{14}$ may each have a substituent (such as methyl, ethyl, phenyl of chlorine).

The following are typical examples of the dyes having the foregoing Formulas [IV], [V] and [VI], applicable to this invention.

IV-1
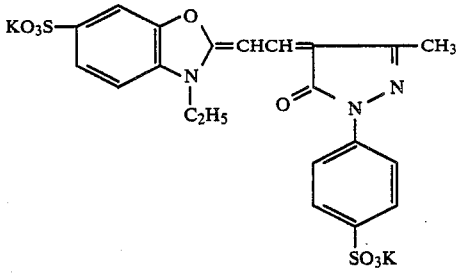
IV-2
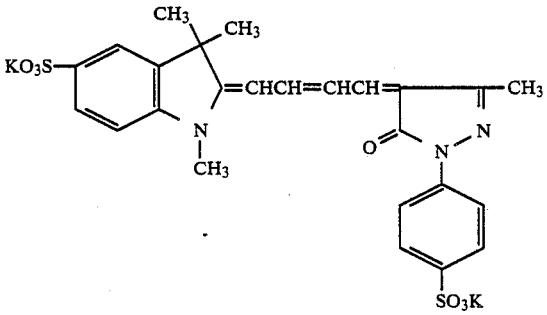
IV-3
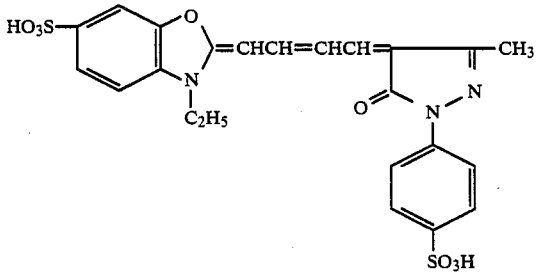
IV-4
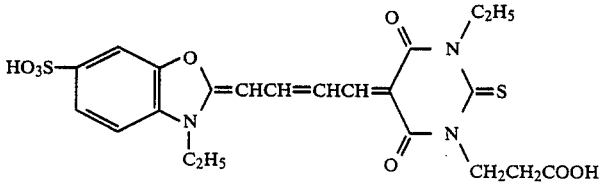
IV-5
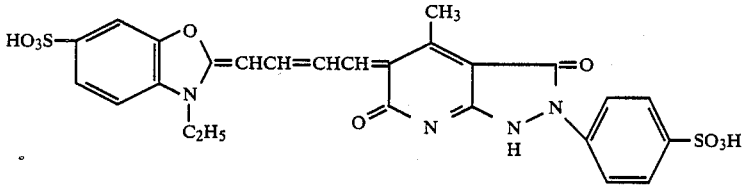
IV-6
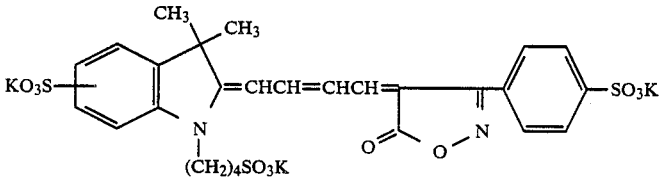
IV-7
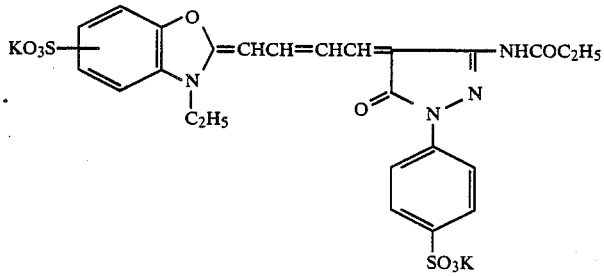

-continued
IV-8
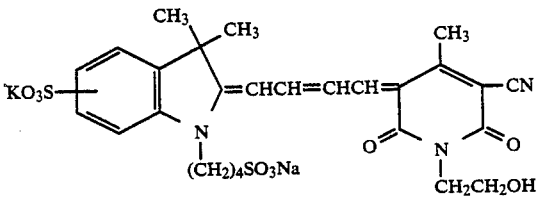
V-1
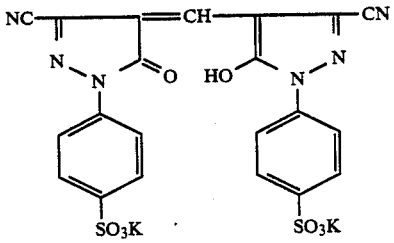
V-2
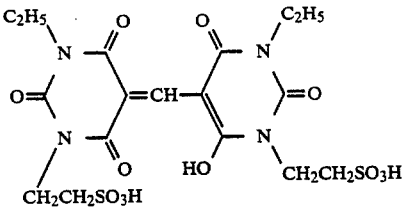
V-3
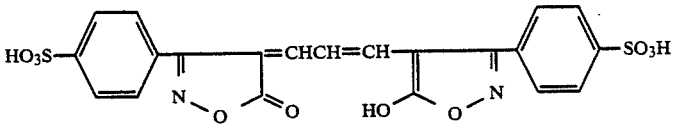
V-4
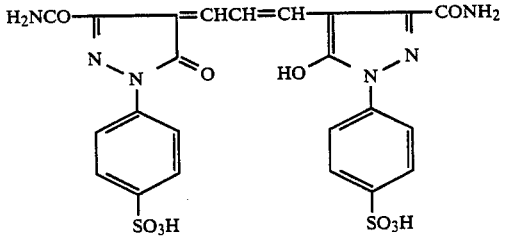
V-5
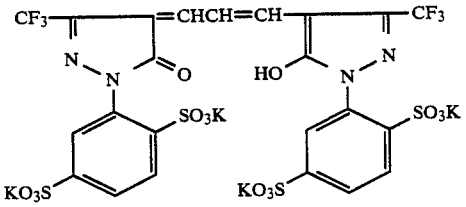
V-6
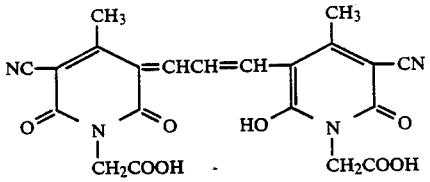
V-7
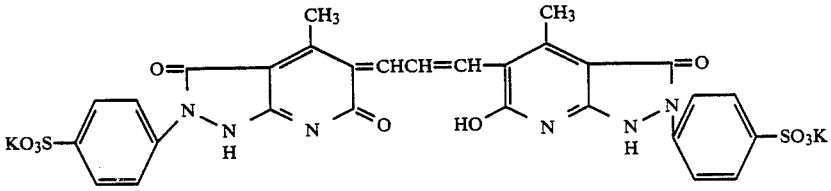

-continued
V-8
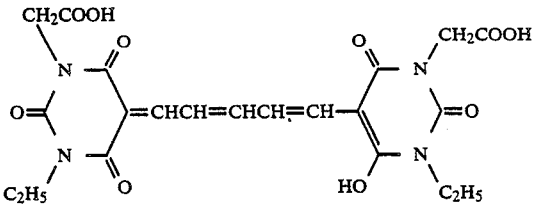
V-9
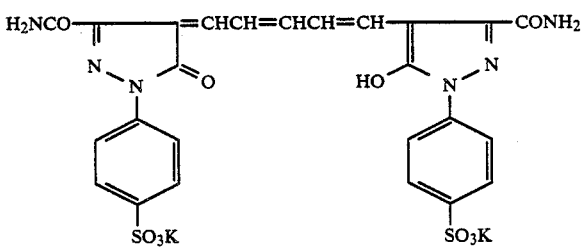
V-10
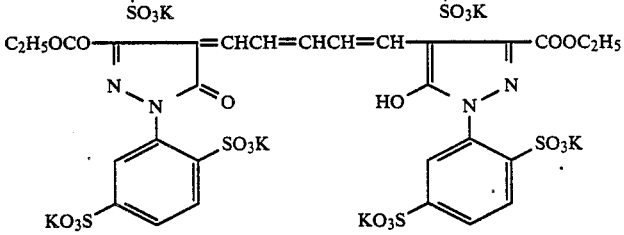
V-11
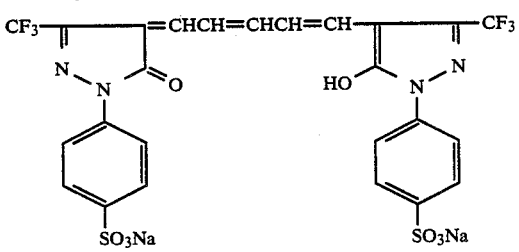
VI-1
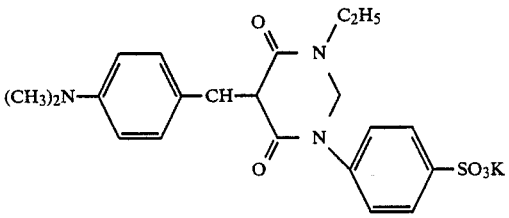
VI-2
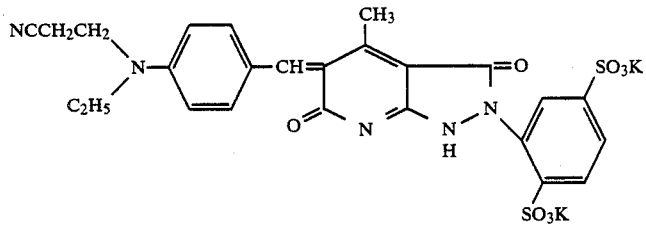
VI-3
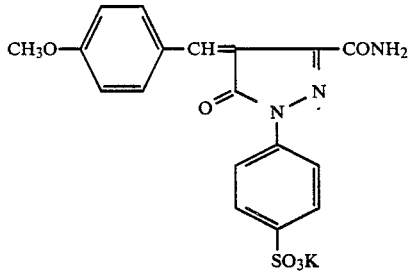
VI-4
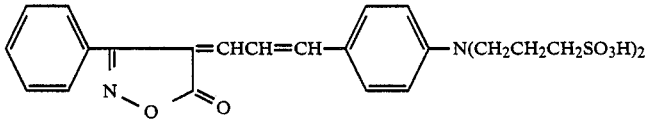

-continued

VI-5

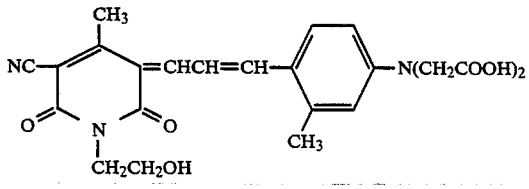

VI-6

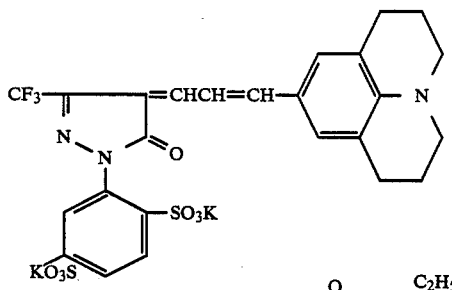

VI-7

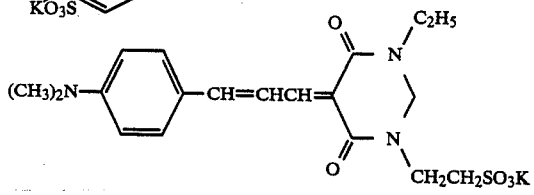

VI-8

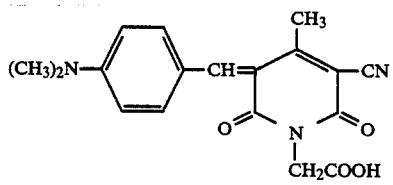

These bleachable dyes according to this invention are compounds of the prior art, and may be synthesized by making reference to, e.g., Belgian Patent No. 869467, British Patent No. 1,521,083, Japanese Patent Examined Publication Nos. 51898/1972 and 3286/1973, Japanese Patent O.P.I. Publication Nos. 62826/1973, 5125/1974, 40625/1975, 91627/1975, 60825/1977, 109524/1977, 111717/1977, 111717/1977, 13533/1977, 1145/1983, 11857/1983, 65756/1983, 65757/1983, 143342/1983, 80470/1984, 111640/1984 and 118438/1984.

According to the present invention, the anti-irradiation dyes represented by Formulas [IV], [V] and [VI] may, in view of their diffusible nature, be incorporated into any one or more of layers constituting the photographic material of this invention, i.e., in a light-sensitive emulsion layer or a non-light-sensitive layer including an intermediate layer between two light-sensitive emulsion layers or between the support and other light-sensitive or non-light-sensitive layer and a protective layer.

According to one of the preferable embodiments of the present invention, the anti-irradiation dyes of the invention is incorporated into a light-sensitive emulsion layer.

It is advantageous to use an anti-irradiation dye having the main light absorption in a specific region in combination with a light-sensitive emulsion having the maximum spectral sensitivity in the same spectral region.

It is most advantageous in the present invention that the anti-irradiation dyes having a spectral absorption in the region of 500 nm to 600 nm in combination with a green-sensitive emulsion layer, and one having spectral absorption in the region of 500 nm to 600 nm in combination with a red-sensitive emulsion layer.

The adding amount of the antiirradiation dye of this invention is preferably from 0.3 to 30 g per mole of silver halide. and more preferably from 1 to 10 g.

In this invention, the principal process of forming a direct positive image comprises performing the surface development of an in-advance-unfogged internal latent image-type light-sensitive material while and/or after subjecting it to fogging treatment, wherein the fogging treatment is desirable to be made by overall exposing the light-sensitive material to light.

In this invention, the overall exposure takes place by uniformly overall exposing an imagewise-exposed light-sensitive material after immersing or swelling it in a developer solution or other aqueous solution.

Where the overall exposure is made in a developer solution, for the purpose of shortening the developing time, it is desirable to make the overall exposure in the initial stage of the development, and it is advantageous to commence the exposure after the developer solution is sufficiently permeated into the emulsion layer.

As for the light source for use in the exposure, the use of at least one light source emitting a light within the wavelength regions to which the light-sensitive material is sensitive may be enough, but it is desirable to use at least one light source whose spectral distribution is as wide as the visible rays region range of from 400 to 700 nm. As the light source, a fluorescent lamp high in the color rendering as disclosed in Japanese Patent O.P.I. Publication No. 17350/1981 may also be used. Also, two or more light sources different in the light spectral distribution or color temperature may be combinedly used, or a light source in combination with various filters including a color temperature conversion filter may also be used.

The illuminance of the overall exposure light or the light for use in fogging, although it depends on the light-sensitive material used, is generally from 0.01 lux to 2000 luces, preferably from 0.05 lux to 30 luces, and more preferably from 0.1 lux to 5 luces. Adjustment of the illuminance of the light for use in fogging may be made by varying the light intensity of the light source, using an appropriate filter to reduce the light intensity, or varying the distance or angle between the light-sensitive material and the light source. The use of a weak light in the initial stage of light-fogging may also be adopted. For example, Japanese Patent Examined Publication No. 6936/1983 discloses a method in which overall exposure is made while increasing the illuminance.

As an exposure device applicable to the overall exposure, any of those devices disclosed in, e.g., Japanese Utility Model O.P.I. Publication Nos. 130935/1981, 145049/1981, 87051/1984 and 870521/1984, and Japanese Patent Application No. 235165/1984 can be advantageously used.

The developing method to be used in this invention may be an arbitrary developing method, but is preferably a surface developing method. The surface developing method implies that the light-sensitive material is developed in a developer solution which does substantially not contain any silver halide solvent.

A color developer solution to be applied to this invention contains an aminophenol or p-phenylenediamine-type color developing agent, examples of which include aminophenol, N-methylaminophenol, N,N-diethyl-p-phenylenediamine, diethyl- amino-o-toluidine, 4-amino-3-methyl-N-ethyl-N-(β-methanesulfonamidoethyl)aniline, 4-amino-3-methyl-N-(β-hydroxyethyl)aniline and the like. Such the developing agent may in advance be incorporated into the light-sensitive material, and the light-sensitive material may be immersed in a high pH aqueous solution to have the agent act upon the silver halide.

The developer solution to be used in this invention may additionally contain specific antifoggant and development restrainer, or such additives, instead of being added to the solution, may be incorporated discretionarily into the layer of the light-sensitive material. In general, useful antifoggants include benzotriazoles, benzothiazoles, benzoimidazoles, and the like. The developer solution may also contain a development accelerator such as, for example, a polyalkylene oxide derivative, quaternary ammonium salt compound or the like.

The internal latent image-type silver halide emulsion in this invention is an emulsion having a silver halide wherein a latent image is formed mainly inside its grain and having a majority of sensitivity specks inside the grain, and the emulsion contains an arbitrary silver halide such as silver bromide, silver chloride, silver chlorobromide, silver iodobromide, silver chloroiodobromide, or the like.

Particularly preferably, the emulsion, when part of a sample that is obtained by coating the emulsion on a transparent support is subjected to a light intensity scale exposure in a given period of time within about 1 second and then developed at 20° C. for 4 minutes in the following Surface Developer A substantially not containing any silver halide solvent and for developing the grain's surface latent image only, shows a maximum density not more than 1/5 of the maximum density that is obtained when the other part of the same emulsion sample is exposed likewise and then developed at 20° C. for 4 minutes in the following Internal Developer Solution B for developing the internal of the grain. The maximum density obtained by using Surface Developer Solution A is preferably not more than 1/10 of the maximum density that is obtained in Internal Developer Solution B.

| | |
|---|---|
| Surface Developer Solution A | |
| Metol | 2.5 g |
| L-ascorbic acid | 10.0 g |
| Sodium metaborate, tetrahydrated | 38.0 g |
| Potassium bromide | 1.0 g |
| Water to make 1 liter. | |
| Internal Developer Solution B | |
| Metol | 2.0 g |
| Anhydrous sodium sulfite | 90.0 g |
| Hydroquinone | 8.0 g |
| Sodium carbonate, monohydrated | 52.5 g |
| Potassium bromide | 5.0 g |
| Potassium iodide | 0.5 g |
| Water to make 1 liter. | |

The internal latent image-type silver halide emulsion of this invention includes those prepared by various methods; for example, those conversion-type silver halide emulsions as disclosed in U.S. Pat. No. 2,592,250; those silver halide emulsions having internally chemically sensitized silver halide grains as described in U.S. Pat. Nos. 3,206,316, 3,317,322 and 3,369,778; those silver halide emulsions containing multivalent metallic ions-incorporated silver halide grains as disclosed in U.S. Pat. Nos. 3,271,157, 3,447,927 and 3,531,291; those silver halide emulsions having doping agent-containing silver halide grains whose surface is weakly chemically sensitized as disclosed in U.S. Pat. No. 3,761,276; those silver halide emulsions comprising stratified structure-having silver halide grains as disclosed in Japanese Patent O.P.I. Publication Nos. 8524/1975, 38525/1975 and 2408/1978; and those silver halide emulsions as disclosed in Japanese Patent O.P.I. Publications Nos. 156614/1977 and 127549/1980.

Further, the internal latent image-type silver halide emulsion to be used in this invention may contain any of commonly usable stabilizers or antifoggants; for example, polyazaindenes and mercapto group-having nitrogen-containing heterocyclic compounds, such as 4-hydroxy-6-methyl-1,3,3a,7-tetrazaindene and 1-phenyl-5-mercaptotetrazole, whereby lower minimum density-having, more stable results can be obtained.

The silver halide emulsion according to this invention can be optically sensitized by commonly available sensitizing dyes. The combination of sensitizing dyes usable for the supersensitization of internal latent image-type silver halide emulsions, negative-type silver halide emulsions and the like is also useful for the silver halide emulsion of this invention. For such sensitizing dyes reference can be made to Research Disclosure (hereinafter abbreviated to RD) Nos. 15162 and 17643.

The silver halide emulsion according to this invention may, if necessary, contain various additives such as wetting agent, physical property improving agent, coating aid, gelatin plasticizer, surface active agent, ultraviolet absorbing agent, pH adjusting agent, oxidation inhibitor, antistatic agent, viscosity increasing agent, granularity improving agent, dyes, mordant, brightening agent, developing speed control agent, matting agent and the like.

The silver halide emulsion prepared as mentioned above is coated, if necessary, through subbing layer, antihalation layer, filter layer, etc., on a support, whereby an internal latent image-type light-sensitive material of this invention is obtained.

Making the light-sensitive material of this invention into one for full color use is useful. In this instance, the silver halide photographic emulsion is desirable to contain cyan, magenta and yellow dyes-forming couplers.

Of these couplers the yellow dye-forming coupler is a benzoylacetanilide-type coupler, pivaloylacetanilide-type coupler or two-equivalent-type yellow dye-forming coupler whose carbon atom in the coupling position is substituted by a substituent (the so-called split-off group) that is capable of being split off upon the coupling reaction; the magenta dye-forming coupler is a 5-pyrazolone-type, pyrazolotriazole-type, pyrazolinobenzimidazole-type. indazolone-type or split off group-having two-equivalent-type magenta dye-forming coupler; and the cyan dye-forming coupler is a phenol-type, naphthol-type, pyrazoloquinazolone-type or split off group-having two-equivalent-type cyan dye-forming coupler.

In order to prevent the discoloration of a dye image due to short-wavelength actinic rays, it is useful to use ultraviolet absorbing agents such as, e.g., thiazolidone, benzotriazole, acrylonitrile, benzophenone-type compounds; particularly, the single use or combined use of Tinuvin PS, Tinuvin 320, Tinuvin 326, Tinuvin 327 and Tinuvin 328 (all manufactured by Ciba Geigy) is advantageous.

The support of the light-sensitive material to be used in this invention may be of any arbitrary material, but materials typically usable as the support include at-need-subbed polyethylene terephthalate film, polycarbonate film, polystyrene film, polypropylene film, cellulose acetate film, glass plates, baryta paper, polyethylene-laminated paper and the like.

As the protective colloid or binder for the light-sensitive material to be used in this invention, in addition to gelatin, a suitable gelatin derivative may be used according to purposes. Examples of the 'suitable gelatin derivative' include, e.g., acylated gelatin, guanidylated gelatin, carbamylated gelatin, cyanoethanolated gelatin, esterified gelatin, and the like.

In this invention, if necessary, different other hydrophilic binder materials may also be used which include, e.g., dextran, cellulose derivative, polyacrylamide, polyvinyl alcohol, polyvinyl pyrrolidone, hydrolyzed polyvinyl acetate, and the like. Such the hydrophilic binder material may be added, if necessary, to light-sensitive material's component layers such as emulsion layers, interlayers, protective layer, filter layers, backing layer and the like, and further, into the hydrophilic binder may be incorporated at need appropriate plasticizer, lubricant, and the like.

The component layers of the light-sensitive material of this invention may be hardened by using an arbitrary hardening agent, examples of which include chromium salts, zirconium salts, aldehyde-type and halotriazine-type compounds such as formaldehyde and mucohalogenic acid, polyepoxy compounds, ethyleneimine-type, vinylsulfone-type and acryloyl-type hardening agents, and the like.

The light-sensitive material to be used in this invention is effectively applicable to various uses such as general color photography use, false color photography use, graphic arts use, microfilm use, silver dye bleach process use, and the like, and also to the colloid transfer process as well as to those color image transfer processes, color diffusion transfer processes, absorption transfer processes, etc., as disclosed in Rogers, U.S. Pat. Nos. 3,087,817, 3,185,567 and 2,983,606; Weyerts et at, U.S. Pat. No. 3,253,915; Whitmore et al, U.S. Pat. No. 3,227,550; Barr et al, U.S. Pat. No. 3,227,551; Whitmore, U.S. Pat. No. 3,227,552; and Land et al, U.S. Pat. Nos. 3,415,644, 3,415,645 and 3,415,646.

By using the direct positive color light-sensitive material of this invention, satisfactory color positive images having a high maximum density and low minimum density can be obtained.

The present invention will now be illustrated further in detail by the following examples, but the embodiment of the invention is not limited by the examples.

EXAMPLE 1

Preparation of Emulsion S

To 750 ml of a 2.0% inert gelatin solution kept at 50° C., with stirring, were added the following Solutions A1 and B simultaneously in pouring manner spending 3 minutes. After being ripened for 25 minutes, the liquid was subjected to precipitation-washing treatment to remove its excessive salts therefrom, and then redispersed. To this were then added Solutions C1 and D, and after 10 minutes, again excessive water-soluble salts were removed from the mixture and a small amount of gelatin was added to it, whereby the silver halide grains were dispersed.

Preparation of Emulsion L

To 750 ml of a 1.5% inert gelatin solution kept at 60° C., with stirring, were added Solutions A2 and B simultaneously in pouring manner spending 15 minutes. After being ripened for 40 minutes, the liquid was subjected to precipitation-washing treatment to remove its salts therefrom, and then redispersed. To this were added 10 mg of hypo and then Solutions C2 and D2. Ten minutes later, again excessive water-soluble salts were removed from the mixture and a small amount of gelatin was added to it, whereby the silver halide grains were dispersed.

Preparation of Emulsion M

To 750 ml of a 2.0% inert gelatin solution kept at 50° C., with stirring, were added the following Solutions A3 and B simultaneously in pouring manner spending 5 minutes. After being ripened for 25 minutes, the liquid was subjected to precipitation-washing treatment to remove its salts therefrom and then redispersed, and to this were then added Solutions C1 and D2. Ten minutes later, again excessive water-soluble salts were removed from the mixture and a small amount of gelatin was added to it, whereby the silver halide grains were dispersed.

| | |
|---|---|
| Solution A1: | |
| Pure water | 2000 ml |
| NaCl | 35.0 g |
| $NH_4Br$ | 100.6 g |
| KI | 0.8 g |
| Solution A2: | |
| Pure water | 1000 ml |
| NaCL | 26.3 g |
| $NH_4Br$ | 109.6 g |
| KI | 0.8 g |
| Solution A3: | |
| Pure water | 1000 ml |
| NaCl | 38.8 g |
| KBr | 12.0 g |
| Solution B: | |
| Pure water | 1200 ml |
| $AgNO_3$ | 170.0 g |
| Solution C1: | |
| Pure water | 1000 ml |
| NaCl | 60.0 g |
| $NH_4Br$ | 6.9 g |
| Solution C2: | |
| Pure water | 1000 ml |
| NaCl | 31.6 g |
| Solution D1: | |
| Pure water | 1000 ml |
| $AgNO_3$ | 70.0 g |
| Solution D2: | |
| Pure water | 1000 ml |
| $AgNO_3$ | 80.0 g |

These three emulsions, after adding sensitizing dyes, couplers, etc., thereto as described below, were used to coat the following Layer 1 to Layer 9 simultaneously on a surface-treated polyethylene-laminated paper support, whereby multilayer color light-sensitive material samples were prepared.

Red-sensitive emulsion layer (Layer 1):

To each of Emulsion S and Emulsion M were added separately the different sensitizing dyes given in Table 1 in an amount of $3\times10^{-4}$ mole per mole of silver halide. Stabilizers T-1 and T-2, Surface Active Agent S-2, and further a protect-dispersed coupler liquid containing dibutyl phthalate, ethyl acetate, Surface Active Agent S-2, 2,5-dioctylhydroquinone and Cyan Couplers C-1 and C-2 (both in an amount of 0.1 mole per mole of silver halide).

Subsequently, the different antiirradiation dyes shown in Table 1 were separately added and then gelatin was added to the emulsions, and the emulsions were mixed and coated so as to obtain a gamma value of 1.6

First intermediate layer (Layer 2):

A gelatin liquid containing a protect-dispersed liquid comprising dioctyl phthalate, 2,5-dioctylhydroquinone, ultraviolet absorbing agent Tinuvin 328 (product of Ciba Geigy) and Surface Active Agent S-1 was prepared and coated so that the coating weight of Tinuvin 328 was 0.15 g/m$^2$.

Green-sensitive emulsion layer (Layer 3):

To each of Emulsion S and Emulsion M were added separately the different sensitizing dyes in an amount of $3\times10^{-4}$ mole per mole of silver halide, Stabilizers T-1 and T-2, Surface Active Agent S-2, and further a protect-dispersed coupler liquid containing dibutyl phthalate, ethyl acetate, 2,5-dioctylhydroquinone, Surface Active Agent S-1 and Magenta Coupler M-1 (in an amount of 0.2 mole per mole of silver halide).

And the different antiirradiation dyes given in Table 1, gelatin and further Hardening Agent H-1 were added to the emulsions, and the emulsions were mixed and then coated so as to have a gamma value of 1.6.

Second intermediate layer (Layer 4):

The same composition as that of the first intermediate layer was coated so that the coating weight of Tinuvin 328 was 0.2 g/m$^2$.

Yellow filter layer (Layer 5):

To yellow colloidal silver that was prepared by being oxidized in the presence of an alkaline weak reducing agent (after neutralization, the weak reducing agent was removed by noodle-washing method) were added dioctyl phthalate, ethyl acetate, Surface Active Agent S-1, 2,5-dioctylhydroquinone, Surface Active Agent S-2, and Hardening Agent H-1, and the mixture liquid was coated so that the coating weight of the colloidal silver was 0.15 g/m$^2$.

Third intermediate layer (Layer 6):

The same in the composition as the first intermediate layer.

Blue-sensitive emulsion layer (Layer 7):

To each of Emulsions L, S and M were added separately the different sensitizing dyes given in Table 1 in an amount of $3\times10^{-4}$ mole per mole of silver halide, Stabilizers T-1 and T-2 and Surface Active Agent S-2, and further a protect-dispersed coupler liquid containing dibutyl phthalate, ethyl acetate, 2,5-dioctylhydroquinone, Surface Active Agent S-1 and Yellow Coupler Y-1 (in an amount of 0.3 mole per mole of silver halide).

Subsequently, gelatin was added and further Hardening Agent H-1 was added to the emulsions, and these emulsions were mixed and coated so as to have a gamma value of 1.6.

Fourth intermediate layer (Layer 8):

The same composition as that of the first intermediate layer was coated so that the coating weight of Tinuvin 328 was 0.35 g/m$^2$.

Protective layer (Layer 9):

A gelatin liquid containing colloidal silica, Coating Aid S-2, and Hardening Agents H-2 and H-3 was coated so that the coating weight of the gelatin was 1.0 g/m$^2$.

In addition, Layer 1, Layer 3 and Layer 7 were coated so that the coating weights of silver (metallic silver equivalent) were 0.3 g/m$^2$, 0.4 g/m$^2$ and 0.7 g/m$^2$, respectively.

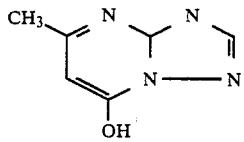

T-1

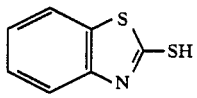

T-2

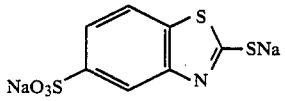

T-3

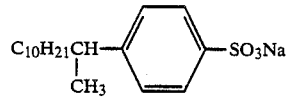

S-1

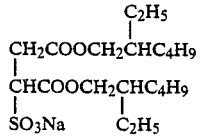

S-2

-continued

H-1

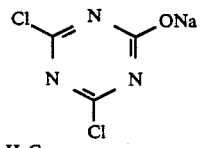

H-2

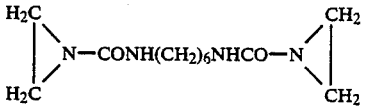

H-3

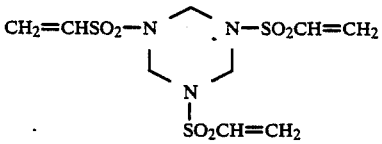

Y-1

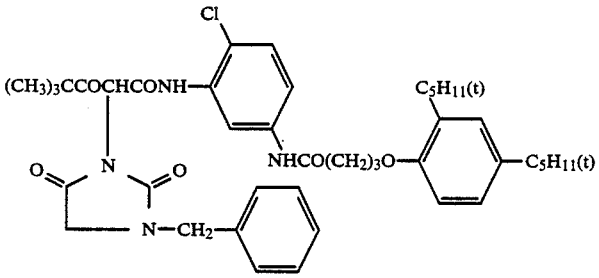

M-1

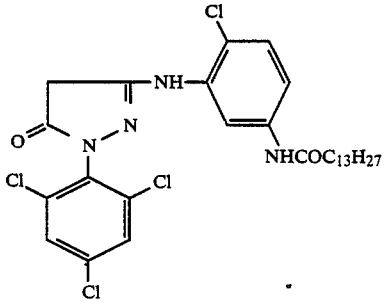

C-1

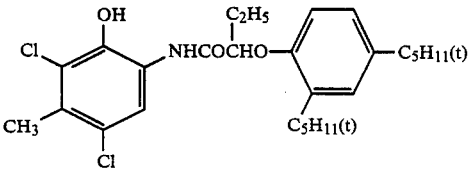

C-2

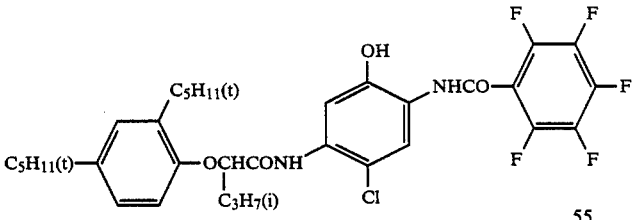

Each of the thus prepared light-sensitive material samples was exposed for 0.5 second through an optical wedge to a white light having a color temperature of 2854° K., and then subjected to the following photographic processing. The fogging exposure in the step [2] of the following processing took place with the illuminance at the sample's plane being varied in stages: 0.125 lux, 0.177 lux, 0.250 lux, 0.354 lux, 0.50 lux, 0.707 lux, 1 lux, 1.414 luces, 2 luces, 2.828 luces, 4 luces, 5.66 luces, 8 luces, 11.3 luces and 16 luces.

| Processing steps | Temperature | Time |
|---|---|---|
| [1] Immersing (in color developer solution) | 38° C. | 8 seconds |

-continued

| Processing steps | Temperature | Time |
|---|---|---|
| [2] Fogging exposure | — | 10 seconds |
| [3] Color developing | 38° C. | 2 minutes |
| [4] Bleach-fix | 35° C. | 60 seconds |
| [5] Stabilizing | 25–30° C. | 1 min. 30 sec. |
| [6] Drying | 75–80° C. | 1 minute. |

| Compositions of the Processing Solutions | |
|---|---|
| <Color Developer> | |
| Benzyl alcohol | 10 ml |
| Ethylene glycol | 15 ml |
| Potassium sulfite | 2.0 g |

-continued

| Compositions of the Processing Solutions | |
|---|---|
| Potassium bromide | 1.5 g |
| Sodium chloride | 0.2 g |
| Potassium carbonate | 30.0 g |
| Hydroxylamine sulfate | 3.0 g |
| Polyphosphoric acid | 2.5 g |
| 3-Methyl-4-amino-N-ethyl-N-(β-methane-sulfonamidoethyl)aniline sulfate | 5.5 g |
| Brightening agent (4,4'-diaminostilbene-disulfonic acid derivative) | 1.0 g |
| Potassium hydroxide | 0.2 g |
| Add water to make 1 liter, adjust the pH to 10.20. | |
| <Bleach-Fix Bath> | |
| Ferric-ammonium ethylenediaminetetra-acetate, dihydrated | 60.0 g |
| Ethylenediaminetetraacetic acid | 3.0 g |
| Ammonium thiosulfate (70% solution) | 100 ml |
| Ammonium sulfite (40% solution) | 27.5 ml |
| Add water to make 1 liter. Use potassium carbonate or glacial acetic acid to adjust the pH to 7.1. | |
| <Stabilizing Bath> | |
| 5-Chloro-2-methyl-4-isothiazoline-3-one | 1.0 g |
| Ethylene glycol | 10.0 g |
| 1-Hydroxyethylidene-1, 1-diphosphonic acid | 2.5 g |
| Bismuth chloride | 0.2 g |
| Magnesium chloride | 0.1 g |

-continued

| Compositions of the Processing Solutions | |
|---|---|
| Aqueous ammonia (28% solution) | 2.0 g |
| Sodium nitrilotriacetate | 1.0 g |
| Add water to make 1 liter. Use ammonium hydroxide or sulfuric acid to adjust the pH to 7.0. | |

Each processed sample was measured with respect to its reflection densities by blue light, green light and red light.

In the case where each sample is exposed with the illuminance being varied, when the fogging exposure illuminance is not less than $L_1$, if the maximum density by blue light, the maximum density by green light and the maximum density by red light are all not less than 1.8, while when the fogging exposure illuminance is not more than $L_2$, if the minimum density by blue light, the minimum density by green light and the minimum density by red light are all not more than 0.2, then the fogging exposure latitude is defined as log $L_2/L_1$.

This implies that the wider the fogging latitude of the light-sensitive material, the less is the light-sensitive material affected by changes in the characteristic of the light source used.

TABLE 1

| Sample No. | Sensitizing dye (Layer 7) | Sensitizing dye (Layer 3) | Sensitizing dye (Layer 1) | Antiirradiation dye (Layer 3) | Antiirradiation dye )Layer 1) | Fogging exposure latitude |
|---|---|---|---|---|---|---|
| 1 (com.s) | Com. D-1 | Com. D-2 | Com. D-3 | Com. A-1 | Com. A-2 | 0.15 |
| 2 (com.s) | Com. D-1 | Expd.II-2 | Com.D-3 | Expd.IV-1 | Expd.V-11 | 0.23 |
| 3 (com.s) | Expd.I-3 | Expd.II-1 | Expd.III-6 | Com. A-1 | Com. A-2 | 0.20 |
| 4 (com.s) | Com. D-1 | Expd.II-1 | Com. D-3 | Expd.IV-1 | Expd.IV-11 | 0.25 |
| 5 (com.s) | Expd.I-3 | Com. D-2 | Expd.III-6 | Com. A-1 | Expd.V-11 | 0.22 |
| 6 (Inv.s) | Expd.I-3 | Expd.II-1 | Expd.III-6 | Expd.IV-1 | Com. A-2 | 0.43 |
| 7 (Inv.s) | Expd.I-3 | Expd.II-1 | Expd.III-6 | Expd.IV-1 | Expd.V-11 | 0.46 |
| 8 (Inv.s) | Expd.I-3 | Expd.II-5 | Expd.III-6 | Expd.IV-4 | Expd.V-7 | 0.40 |
| 9 (Inv.s) | Expd.I-3 | Expd.II-5 | Expd.III-5 | Expd.IV-4 | Expd.VI-4 | 0.42 |
| 10 (Inv.s) | Expd.I-1 | Expd.II-10 | Expd.III-6 + III-7* | Expd.V-4 | Expd.V-9 | 0.55 |
| 11 (Inv.s) | Expd.I-3 | Expd.II-1 | Expd.III-6 + III-7 | Expd.IV-1 | Expd.V-9 | 0.50 |
| 12 (Inv.s) | Expd.I-1 | Expd.II-5 | Expd.III-6 + III-7 | Expd.V-4 | Expd.V-11 | 0.52 |
| 13 (Inv.s) | Expd.I-9 | Expd.II-5 | Expd.III-7 | Expd.V-6 | Expd.V-7 | 0.37 |
| 14 (Inv.s) | Expd.I-7 | Expd.II-5 | Expd.III-7 | Expd.V-4 | Expd.V-7 | 0.47 |
| 15 (Inv.s) | Expd.I-7 | Expd.II-6 | Expd.III-7 | Expd.V-4 | Expd.V-10 | 0.45 |
| 16 (Inv.s) | Expd.I-7 | Expd.II-6 | Expd.III-13 | Expd.IV-7 | Expd.V-7 | 0.39 |
| 17 (Inv.s) | Expd.I-12 | Expd.II-6 | Expd.III-13 | Expd.IV-7 | Expd.V-10 | 0.38 |
| 18 (Inv.s) | Expd.I-12 | Expd.II-3 | Expd.III-13 | Expd.IV-7 | Expd.VI-2 | 0.34 |
| 19 (Inv.s) | Expd.I-12 | Expd.II-3 | Expd.III-15 | Expd.IV-4 | Expd.VI-2 | 0.35 |
| 29 (Inv.s) | Expd.I-15 | Expd.II-5 | Expd.III-6 | Expd.IV-1 | Expd.V-10 | 0.48 |

Note:

*III 6 in $2.5 \times 10^{-4}$ mole and III-7 in $5 \times 10^{-5}$ mole per mole of AgX were added.

'Com.s' stands for comparative sample, 'Inv.s'for invention sample, 'Com.' for comparative compound, and 'Expd' for exemplified compound.

D-1

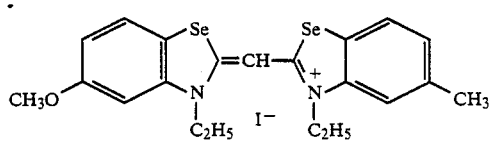

D-2

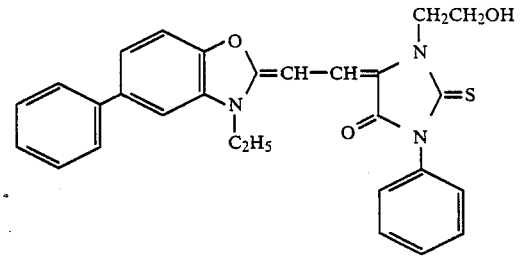

TABLE 1-continued

| Sample No. | Sensitizing dye (Layer 7) | Sensitizing dye (Layer 3) | Sensitizing dye (Layer 1) | Antiirradiation dye (Layer 3) | Antiirradiation dye )Layer 1) | Fogging exposure latitude |
|---|---|---|---|---|---|---|
| D-3 | 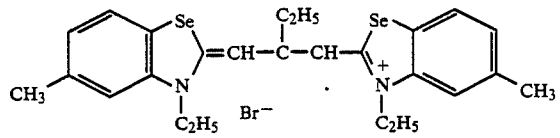 | | | | | |
| A-1 | 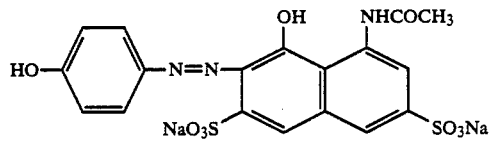 | | | | | |
| A-2 | 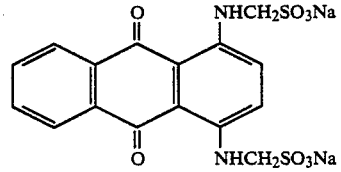 | | | | | |

As is apparent from Table by combinedly using the sensitizing dye and the antiirradiation dye of this invention, wide fogging exposure latitude-having internal latent image-type direct positive color light-sensitive materials can be prepared.

What is claimed is:

1. A direct positive silver halide light-sensitive color photographic material which comprises at least three light-sensitive silver halide emulsion layers containing internal latent image-type light-sensitive silver halide grains and sensitizing dyes having the following Formulas [I], [II] and [III], respectively, and at least one compound selected from the group consisting of those compounds having the following Formulas [IV], [V] and [VI];

Formula [I]

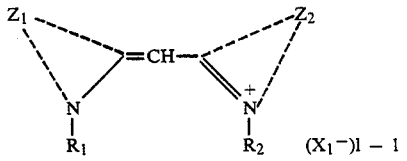

wherein $Z_1$ and $Z_2$ each is a group of atoms necessary to form a benzothiazole ring, naphthothiazole ring, benzoselenazole ring or naphthoselenazole ring: $R_1$ and $R_2$ each is a substituted or unsubstituted alkyl group, provided that at least one of the $R_1$ and $R_2$ is a sulfo or carboxyl group-substituted alkyl group; $X_1^-$ is an anion; and l is an integer of 1 or 2;

Formula [II]

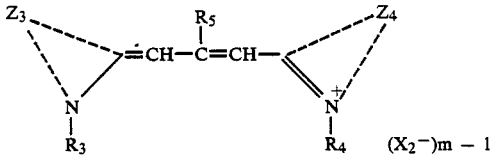

wherein $Z_3$ and $Z_4$ each is a group of atoms necessary to form a benzoxazole ring or naphthoxazole ring: $R_3$ and $R_4$ each is a substituted or unsubstituted alkyl group, and $R_5$ is an lower alkyl group, provided that at least one of the $R_3$ and $R_4$ is a sulfo or carboxyl group-substituted alkyl group; $X_2^-$ is an anion; and m is an integer of 1 or 2;

Formula [III]

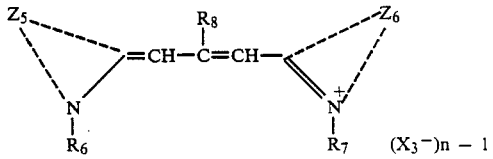

wherein $Z_5$ and $Z_6$ each is a group of atoms necessary to form a benzothiazole ring, naphthothiazole ring, benzoselenazole ring or naphthoselenazole ring: $R_6$ and $R_7$ each is a substituted or unsubstituted alkyl group, and $R_8$ is an alkyl or aryl group, provided that at least one of the $R_6$ and $R_7$ is a sulfo or carboxyl group-substituted alkyl group; $X_3^-$ is an anion; and n is an integer of 1 or 2;

Formula [IV]

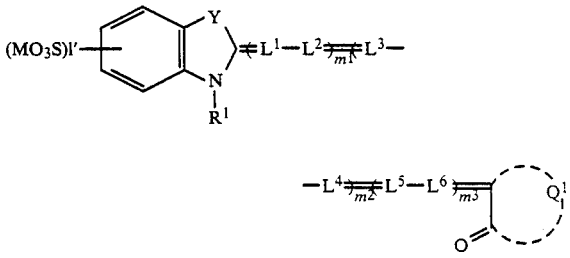

wherein Y is an oxygen atom, $=NR_2$, $=C(CH_3)$ or a sulfur atom; $Q^1$ is a group of atoms necessary to form a pyrazolone ring, isooxazolone ring, barbituric acid ring, thiobarbituric acid ring, tetrahydropyridine-2,6-dione ring or pyrazolo[3,4-b]pyridine-3,6-dione ring: $R^1$ and $R^2$ each is an alkyl group; M is a hydrogen atom or a cation; $L^1$, $L^2$, $L^3$, $L^4$, $L^5$ and $L^6$ each is a methine group: l' is an integer of 1 or 2; and $m^1$, $m^2$ and $m^3$ each is zero or 1;

Formula [V]

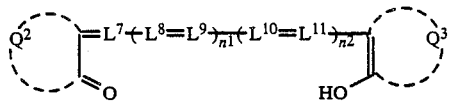

wherein $Q^2$ and $Q^3$ each is a group of atoms necessary to form an isooxazolone ring, barbituric acid ring, thiobarbituric acid ring, tetrahydropyridine-2,6-dione ring, pyrazolo[3,4-b]pyridine-3,6-dione ring or

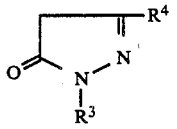

or a tautomer of each of these keto rings; $R_3$ is an aryl group; $R_4$ is a carbamoyl group, alkoxycarbonyl group, aryloxycarbonyl group, perfluoroalkyl group or cyano group; provided that at least one of the $Q^2$ and $Q^3$ has a sulfo or carboxyl group-substituted alkyl, aryl or heterocyclic group; $L^7$, $L^8$, $L^9$, $L^{10}$ and $L^{11}$ each is a methine group; and $n^1$ and $n^2$ each is an integer of zero or 1;

Formula [VI]

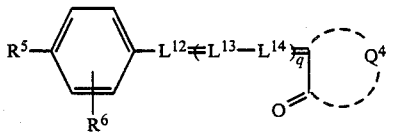

wherein $Q^4$ is a group of atoms necessary to form an isooxazolone ring, barbituric acid ring, thiobarbituric acid ring, pyrazolo[3,4-b]pyridine-3,6-dione ring or

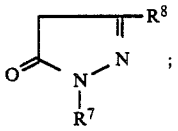

$R_7$ and $R_8$ represent the same groups as defined in the $R_3$ and $R_4$, respectively, of Formula [V]; $R_5$ is an alkoxy group or amino group: $R_6$ is a hydrogen atom, halogen atom, alkyl or alkoxy group; $L^{12}$, $L^{13}$ and $L^{14}$ each is a methine group; and q is an integer of zero or 1.

2. The direct positive silver halide light-sensitive color photographic material of claim 1, wherein $Z_1$ and $Z_2$ in formula [I] respectively represent a group of atoms necessary to complete a benzothiazole ring.

3. The direct positive silver halide light-sensitive color photographic material of claim 1, wherein at least one of $R_1$ and $R_2$ in formula [I], at least one of $R_3$ and $R_4$ in formula [II], and at least one of $R_6$ and $R_7$ in formula [III] respectively represent an alkyl group of which one hydrogen atom has been substituted by a sulfo group or a carboxyl group, said alkyl group having not more than five carbon atoms.

4. The direct positive silver halide light-sensitive color photographic material of claim 1, wherein $R_5$ in formula [II] is an alkyl group having not more than 4 carbon atoms.

5. The direct positive silver halide light-sensitive color photographic material of claim 1, wherein the sensitizing dye of Formula [I] is incorporated in a blue-sensitive emulsion layer, the sensitizing dye of Formula [II] in a green-sensitive emulsion layer, and the sensitizing dye of Formula [III] in a red-sensitive emulsion layer.

6. The direct positive silver halide light-sensitive color photographic material of claim 1, wherein the compounds represented by the formulas [IV], [V] and/or [VI] are incorporated into at least one of the light-sensitive silver halide emulsion layer.

7. The direct positive silver halide light-sensitive color photographic material of claim 1, wherein the compound is selected from ones having a spectral absorption in the region of 500 nm to 600 nm and incorporated in a green-sensitive emulsion layer or ones having spectral absorption in the region of 500 nm to 600 nm and is incorporated in a red-sensitive emulsion layer.

* * * * *